US008721374B2

(12) United States Patent
Glick et al.

(10) Patent No.: US 8,721,374 B2
(45) Date of Patent: May 13, 2014

(54) ELECTRICAL CONNECTOR

(75) Inventors: Michael Glick, Farmington Hills, MI (US); Reinhard Pusch, Farmington Hills, MI (US); David Menzies, Linden, MI (US); Reshma Rathod, Auburn Hills, MI (US); Slobodan Pavlovic, Novi, MI (US); Sheikh Habibur Rahman, Macomb, MI (US)

(73) Assignee: Lear Corporation, Southfield, MI (US)

( * ) Notice: Subject to any disclaimer, the term of this patent is extended or adjusted under 35 U.S.C. 154(b) by 39 days.

(21) Appl. No.: 13/471,698

(22) Filed: May 15, 2012

(65) Prior Publication Data

US 2013/0023163 A1 Jan. 24, 2013

Related U.S. Application Data

(60) Provisional application No. 61/510,712, filed on Jul. 22, 2011.

(51) Int. Cl.
*H01R 13/514* (2006.01)

(52) U.S. Cl.
USPC ..... 439/752; 439/596

(58) Field of Classification Search
USPC ..... 439/752, 744, 595, 596
See application file for complete search history.

(56) References Cited

U.S. PATENT DOCUMENTS 5,554,051 A 9/1996 Shinji et al.
5,980,331 A * 11/1999 Matsushita et al. ..... 439/752
6,146,200 A * 11/2000 Ito et al. ..... 439/596
6,183,314 B1 * 2/2001 Wada et al. ..... 439/752
6,425,780 B1 7/2002 Muhlmichel
6,494,781 B2 * 12/2002 Fujita et al. ..... 439/635
6,524,133 B2 2/2003 Murakami
6,575,795 B1 * 6/2003 Kashiyama ..... 439/752
6,595,807 B2 * 7/2003 Kashiyama ..... 439/752
6,604,966 B1 * 8/2003 Hayes et al. ..... 439/752
6,767,259 B2 * 7/2004 Kojima et al. ..... 439/752
6,769,934 B2 * 8/2004 Nakamura et al. ..... 439/595
6,835,102 B2 * 12/2004 Kayama ..... 439/686
6,835,105 B1 * 12/2004 Nakamura et al. ..... 439/752
6,896,560 B2 * 5/2005 Nakamura et al. ..... 439/752

(Continued)

FOREIGN PATENT DOCUMENTS

JP 2003-100376 A 4/2003

OTHER PUBLICATIONS

Machine Translation of JP 2003-100376, published Apr. 4, 2003.

*Primary Examiner* — Ross Gushi
(74) *Attorney, Agent, or Firm* — Brooks Kushman P.C.

(57) ABSTRACT

An electrical connector includes an electrical terminal and a housing having a front end and a back end with an opening configured to receive the electrical terminal. The housing includes a first lock system configured to allow insertion of the electrical terminal into the housing and prohibit removal of the electrical terminal from the housing. It also includes a tapered surface and for guiding the electrical terminal to a desired position when the electrical terminal is inserted into the housing. A second lock system cooperates with the housing in a lock position for prohibiting removal of the electrical terminal from the housing. It also cooperates with the housing in a pre-lock position wherein a tapered surface of the second lock system is configured to cooperate with the tapered surface of the housing for guiding the electrical terminal to the desired position when the electrical terminal is inserted into the housing.

11 Claims, 4 Drawing Sheets

(56) References Cited

U.S. PATENT DOCUMENTS

| | | | | |
|---|---|---|---|---|
| 6,935,904 | B2 * | 8/2005 | Ishiyama | 439/752 |
| 7,201,615 | B2 * | 4/2007 | Kojima | 439/752 |
| 7,204,725 | B2 * | 4/2007 | Yamashita | 439/752 |
| 7,204,726 | B2 * | 4/2007 | Yamashita et al. | 439/752 |
| 7,207,841 | B2 * | 4/2007 | Machida et al. | 439/595 |
| 7,223,124 | B2 | 5/2007 | Nakamura et al. | |
| 7,261,603 | B2 | 8/2007 | Takahashi et al. | |
| 7,278,883 | B2 | 10/2007 | Tyler | |
| 7,278,890 | B1 * | 10/2007 | Smutny et al. | 439/752 |
| 7,416,453 | B2 | 8/2008 | Germani | |
| 7,500,887 | B2 * | 3/2009 | Ichio | 439/752 |
| 7,556,538 | B2 * | 7/2009 | Nakamura | 439/752 |
| 7,556,539 | B2 * | 7/2009 | Takahashi et al. | 439/752 |
| 7,563,134 | B2 * | 7/2009 | Kim, II | 439/578 |
| 7,563,135 | B2 * | 7/2009 | Takahashi et al. | 439/595 |
| 7,625,251 | B2 * | 12/2009 | Martin et al. | 439/752 |
| 8,052,489 | B2 * | 11/2011 | Mase et al. | 439/752 |
| 2001/0005657 | A1 * | 6/2001 | Kashiyama | 439/752 |
| 2001/0016457 | A1 * | 8/2001 | Taguchi et al. | 439/752 |
| 2001/0027067 | A1 * | 10/2001 | Kojima et al. | 439/752 |
| 2002/0013105 | A1 * | 1/2002 | Kashiyama | 439/752 |
| 2003/0096533 | A1 * | 5/2003 | Kojima et al. | 439/595 |
| 2003/0148669 | A1 * | 8/2003 | Ishikawa et al. | 439/752 |
| 2003/0190841 | A1 * | 10/2003 | Nakamura et al. | 439/595 |
| 2003/0190842 | A1 * | 10/2003 | Fukatsu et al. | 439/595 |
| 2004/0005821 | A1 * | 1/2004 | Nankou et al. | 439/752 |
| 2004/0242083 | A1 * | 12/2004 | Ishiyama | 439/752 |
| 2004/0253884 | A1 * | 12/2004 | Sakurai et al. | 439/752 |
| 2005/0112943 | A1 * | 5/2005 | Sagawa et al. | 439/595 |
| 2005/0124216 | A1 * | 6/2005 | Sagawa et al. | 439/595 |
| 2005/0170703 | A1 * | 8/2005 | Nakamura | 439/752 |
| 2005/0170704 | A1 * | 8/2005 | Ishikawa et al. | 439/752 |
| 2005/0247476 | A1 * | 11/2005 | Aihara et al. | 174/50.52 |
| 2006/0052004 | A1 * | 3/2006 | Yamashita | 439/595 |
| 2006/0063427 | A1 * | 3/2006 | Tanaka et al. | 439/595 |
| 2006/0068647 | A1 * | 3/2006 | Kojima | 439/752 |
| 2006/0073739 | A1 * | 4/2006 | Aihara | 439/752 |
| 2006/0084326 | A1 * | 4/2006 | Horiuchi et al. | 439/752 |
| 2006/0189219 | A1 * | 8/2006 | Yamashita et al. | 439/752 |
| 2007/0275609 | A1 * | 11/2007 | Lamdiziz et al. | 439/752 |
| 2007/0281555 | A1 * | 12/2007 | Suemitsu et al. | 439/752 |
| 2008/0020639 | A1 * | 1/2008 | Ichio | 439/595 |
| 2008/0020653 | A1 * | 1/2008 | Horiuchi | 439/752 |
| 2008/0305694 | A1 * | 12/2008 | Takahashi et al. | 439/752 |
| 2009/0081908 | A1 * | 3/2009 | Martin et al. | 439/752 |
| 2009/0130902 | A1 * | 5/2009 | Hall et al. | 439/595 |
| 2009/0247000 | A1 * | 10/2009 | Shuey | 439/358 |
| 2009/0269963 | A1 * | 10/2009 | Brown et al. | 439/357 |
| 2010/0062660 | A1 * | 3/2010 | Itou et al. | 439/752 |
| 2011/0223789 | A1 | 9/2011 | Sasaki et al. | |
| 2013/0023163 | A1 * | 1/2013 | Glick et al. | 439/752 |

* cited by examiner

ELECTRICAL CONNECTOR

CROSS-REFERENCE TO RELATED APPLICATIONS

This application claims the benefit of U.S. provisional patent application No. 61/510,712, filed on 22 Jul. 2011, which is hereby incorporated herein by reference.

TECHNICAL FIELD

The present invention relates to an electrical connector having an electrical terminal and a housing including a locking system configured to retain the electrical terminal.

BACKGROUND

Electrical connectors may have a number of design requirements depending on the their intended use. Some of these requirements include assurance of correct orientation or polarity of the terminal, minimum retention force for a terminal inside a housing, and the ability to remove a terminal and reinsert it, or insert a new terminal, into the same housing, just to name a few such requirements. Examples of electrical connectors are described in the following patents and patent applications: U.S. Pat. Nos. 5,554,051, 6,524,133, 7,223,124, 7,278,883, US20110223789 and JP2003100376.

SUMMARY

Embodiments of the invention include an electrical connector including an electrical terminal and a housing. The housing has a front end and a back end having an opening configured to receive the electrical terminal therethrough. The housing includes a first lock system configured to allow insertion of the electrical terminal into the housing and prohibit removal of the electrical terminal therefrom. The housing includes a tapered surface therein for guiding the electrical terminal to a desired position when the electrical terminal is inserted into the housing. A second lock system is configured to cooperate with the housing in a lock position for prohibiting removal of the electrical terminal from the housing. The second lock system also cooperates with the housing in a pre-lock position wherein a tapered surface of the second lock system is configured to cooperate with the tapered surface of the housing for guiding the electrical terminal to the desired position when the electrical terminal is inserted into the housing.

Embodiments of the invention include an electrical connector including an electrical terminal and a housing. The housing includes a front end and a back end including an opening therein for facilitating insertion of the electrical terminal into the housing such that the housing at least partially encloses the electrical terminal. The housing further includes a wall having a tapered interior surface for guiding the electrical terminal to a desired position when the electrical terminal is inserted into the housing. The housing also includes a locking beam having a lock position for prohibiting removal of the electrical terminal from the housing and a release position for facilitating removal of the electrical terminal from the housing. A blocking member has a tapered surface thereon and is configured for insertion into the housing such that when it is partially inserted into the housing, its tapered surface cooperates with the tapered interior surface of the wall for guiding the electrical terminal to the desired position when the electrical terminal is inserted into the housing. When the blocking member is fully inserted into the housing, it blocks removal of the electrical terminal from the housing.

Embodiments of the invention include an electrical connector including an electrical terminal and a housing configured to at least partially enclose the electrical terminal. The housing includes a locking beam cantilevered toward a front of the housing and having a lock position in which the locking beam is engaged with the electrical terminal, and a release position in which the locking beam is not engaged with the electrical terminal. The housing includes a back end through which the electrical terminal is inserted into the housing, and a front end through which a mating terminal can be inserted to mate with the electrical terminal. The locking beam includes a back surface tapered toward the back end of the housing for guiding the electrical terminal to a desired position when the electrical terminal is inserted into the housing. A lock system is configured for insertion into the housing in a lock position for prohibiting removal of the electrical terminal from the housing. The lock system also has a pre-lock position wherein a tapered surface of the lock system cooperates with the back surface of the locking beam for guiding the electrical terminal to the desired position when the electrical terminal is inserted into the housing.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
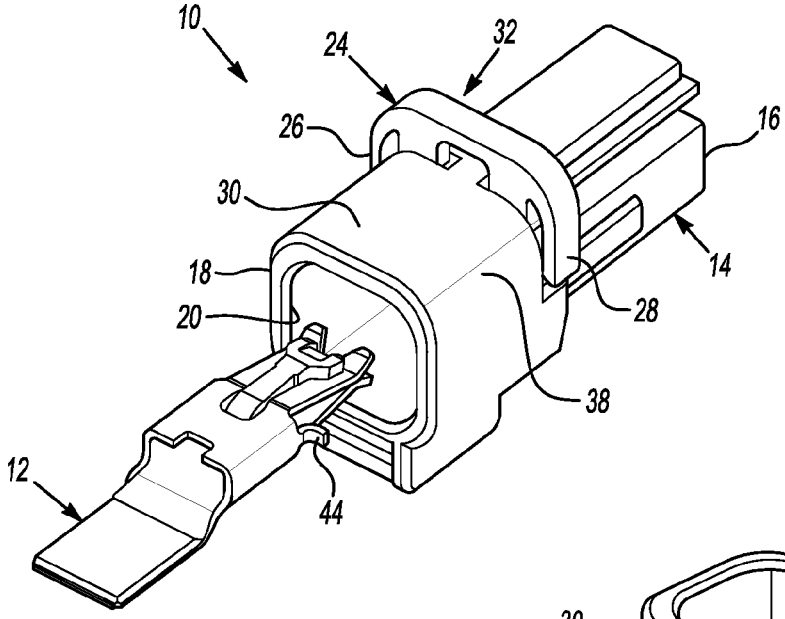
FIG. 1 is a perspective view of an electrical connector in accordance with embodiments of the present invention.

FIG. 1 shows an electrical connector 10 in accordance with embodiments of the present invention. The electrical connector 10 includes an electrical terminal 12, which is configured to be inserted into the housing 14 such that the housing 14 at least partially encloses the electrical terminal 12. The housing 14 includes a front end 16 and a back end 18 having an opening 20, through which the electrical terminal 12 can be inserted. The housing includes a first lock system 22—see FIG. 5—and a second lock system 24, each configured to help retain the electrical terminal 12 within the housing 14, as explained in more detail below. The second lock system 24 includes a pair of retaining arms 26, 28 configured to cooperate with an outside surface 30 of the housing 14, and further includes a blocking member 32, which in this embodiment, includes elongate members 34, 36—see FIG. 2.

The housing 14 includes a wall 38, which may be considered one continuous feature defining the boundaries of the housing 14. Alternatively, the housing 14 can be considered to include a number of walls, but in the case of a molded polymeric component, such as the housing 14, it is convenient to refer to a single wall, such as the wall 38. Disposed through the wall 38 are apertures 40, 42, which are configured to receive the elongate members 34, 36 of the lock system 24, the function of which is described below.

Figure 3:
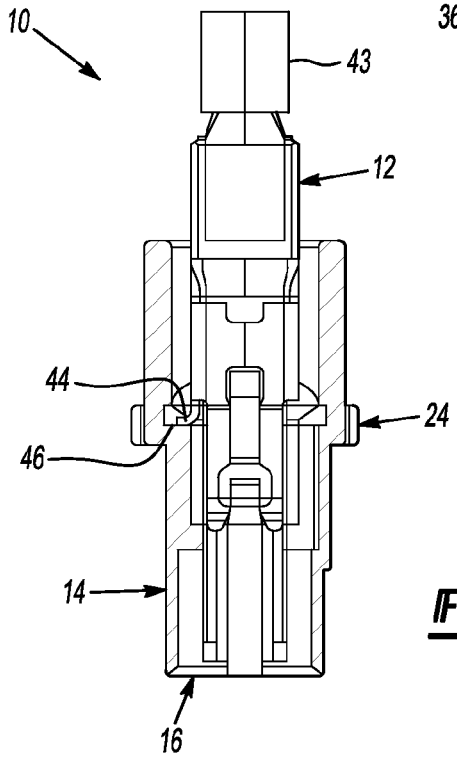
FIG. 3 is a cross-sectional view of a portion of the electrical connector shown in FIG. 1 with the electrical terminal partially inserted into the housing with an incorrect orientation.

FIG. 3 shows a cross section of the electrical connector 10, with the electrical terminal 12 only partially inserted into the housing 14. Also shown in FIG. 3, is a wire 43 connected to the electrical terminal 12. As shown in FIG. 3, a terminal alignment feature or tab 44 (also shown in FIG. 1) is configured to cooperate with a housing alignment feature 46 to help ensure that the electrical terminal 12 is fully insertable into the housing 14 with only one orientation. The housing alignment feature 46 is, in this embodiment, a small ledge that extends inward from an outside of the housing 14 to interfere with the tab 44 if the electrical terminal 12 is inserted with the wrong orientation. This can be important when the polarity of an electrical terminal must be maintained relative to a mating terminal.

Figure 4:
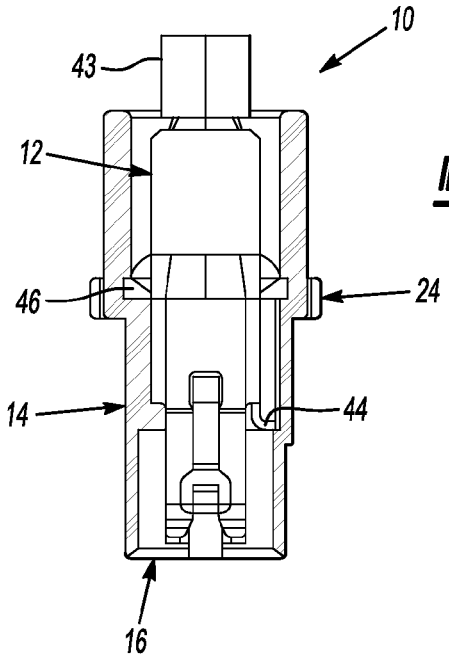
FIG. 4 is a cross-sectional view of the electrical connector shown in FIG. 3 with the electrical terminal fully seated within the housing with a correct orientation.

A housing, such as the housing 14, can be configured with different housing alignment features to interfere with a terminal alignment feature, such as the tab 44. Alternatively, another component, such as a portion of the second lock system 24 can be configured to interfere with the electrical terminal if it is inserted into the housing with the wrong orientation. In other embodiments, where polarity is not an issue, the housing and electrical terminal may be configured to allow insertion of the electrical terminal into the housing with any orientation. FIG. 4 shows the electrical terminal 12 inserted into the housing 14 with the proper orientation, such that the electrical terminal 12 extends almost completely to the front end 16 of the housing 14.

Figure 5:
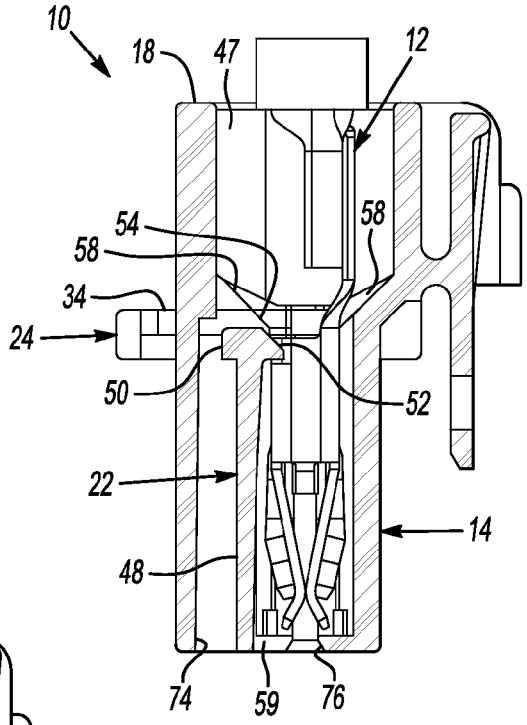
FIG. 5 is a cross-sectional view of the electrical connector shown in FIG. 1 illustrating two lock systems for retaining the electrical terminal in the housing: a primary lock engaged and a secondary lock disengaged.

FIG. 5 shows an interior 47 of the housing 14, where the two lock systems 22, 24 of the electrical terminal 10 are shown in more detail. The two lock systems 22, 24 may conveniently be referred to as a primary lock and a secondary lock, respectively, although the terms are not indicative of their relative importance. The primary lock 22 includes a cantilevered locking beam 48 that is configured to allow insertion of the electrical terminal 12 into the housing 14, and prohibit removal of the electrical terminal 12 out of the housing 14 when the locking beam 48 is in a "lock" position as shown in FIG. 5. The locking beam 48 includes a locking head 50 having a first or back tapered surface 52 disposed toward the back end 18 of the housing 14. Providing such a tapered surface on the locking head 50 facilitates insertion of the electrical terminal 12 from the back end 18 of the housing 14, and as explained below, also helps to guide the electrical terminal 12 into a desired position.

Figure 2:
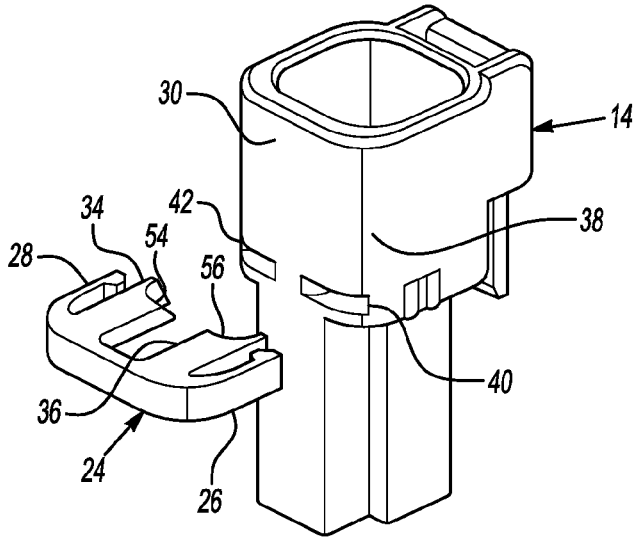
FIG. 2 is a perspective view of a housing and a lock system shown in FIG. 1.

As shown in FIG. 5, the secondary lock 24 also has a tapered surface 54 disposed toward the back end 18 of the housing 14, and as shown in FIG. 2, each of the elongate members 34, 36 have respective tapered surfaces 54, 56. Also shown in FIG. 5 is a tapered interior surface 58 of the wall 38 of the housing 14. Although it is shown in two places in FIG. 5, it is understood that the surface 58 is continuous or generally continuous around the interior 47 of the housing 14. In this way, the back surface 52 of the locking head 50 cooperates with the tapered surfaces 54, 56 of the secondary lock 24, and also cooperates with the tapered surface 58 of the wall 38, to form a generally funnel-shaped interior portion that guides the electrical terminal 12 into the desired position—specifically, it guides it into a channel 59 where it can be fully seated, as shown in FIGS. 5 and 6.

FIG. 5 shows the secondary lock 24 partially inserted into the housing 14 in a "pre-lock" position. In this position, the tapered surfaces 54, 56 of the elongate members 34, 36 help to guide the terminal 12 into its desired position as explained above. Similarly, the first tapered surface 52 of the locking head 50 allows the terminal 12 to be inserted from the back end of the housing 14. Once it is fully seated, the terminal 12 is secured by the locking head 50, which prohibits its removal from the housing 14. As used herein, the word "prohibit" does not mean that it is impossible to remove the electrical terminal 12 from the housing 14; rather, it means that the locking beam 48 (and as applicable the secondary lock 24) maintains the electrical terminal 12 within the housing 14 with a desired amount of retention force.

Figure 6:
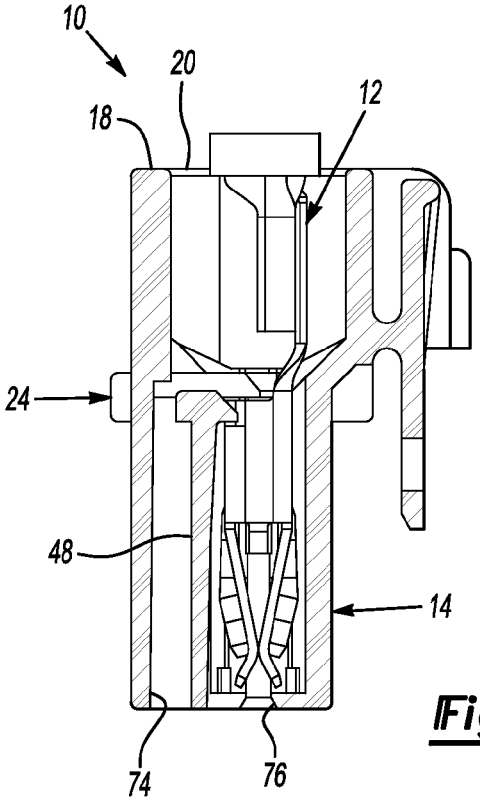
FIG. 6 is a cross-sectional view of the electrical connector shown in FIG. 5 showing the second lock system in a lock position.

FIG. 6 shows a cross-sectional view of the electrical connector 10, similar to the view shown in FIG. 5; however, in FIG. 6, the secondary lock 24 is in the "lock" position. In this position, the locking beam 48 and the secondary lock 24 both act to prohibit removal of the electrical terminal 12 from the housing 14. In this embodiment, both locks 22, 24 are disposed between a portion of the electrical terminal 12 and the opening 20, such that they physically block the electrical terminal 12 from being removed. In this way, the secondary lock 24 acts independently of the primary lock 22. This need not be the case, however, and as described below in conjunction with FIGS. 12 and 13, other embodiments may have a secondary lock that acts on the primary lock in addition to or instead of acting on the electrical terminal.

Figure 7:
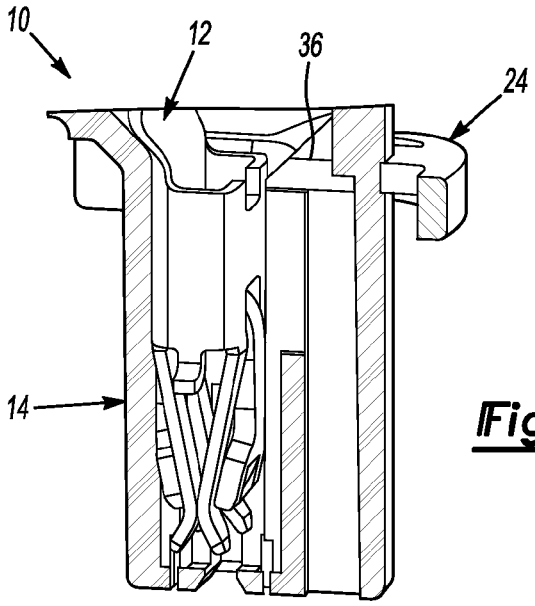
FIG. 7 is a cross-sectional view of the electrical connector shown in FIG. 1 showing the relationship between the position of the electrical terminal and the position of the second lock system.

FIG. 7 shows another cross-sectional view of the electrical connector 10. In particular, FIG. 7 illustrates the relationship between the position of the secondary lock 24, the housing 14, and the electrical terminal 12. As shown in FIG. 7, the electrical terminal 12 is only partially inserted into the housing 14, and is not fully seated. In this position, the secondary lock 24 can be placed in the pre-lock position as illustrated, but it cannot be placed in the lock position, because its movement to the lock position, and in particular, movement of the elongate members 34, 36 of the blocking member 32, is blocked by the electrical terminal 12. In contrast, when the electrical terminal 12 is fully inserted into the housing 14, the secondary lock 24 can be moved to the lock position as shown in FIG. 6.

Figure 8:
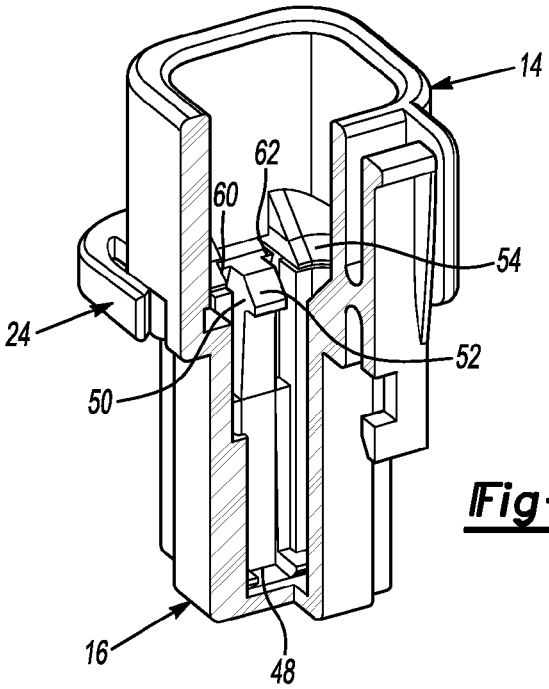
FIG. 8 is a cross-sectional view of the housing of the electrical connector shown in FIG. 1 illustrating features of lock systems for the electrical terminal.

FIG. 8 shows another cross-section sectional view of the electrical connector 10. Shown in this view is the locking beam 48 of the primary lock 22 and the back surface 52 of the locking head 50, each described above. Also shown in this view are second tapered surfaces 60, 62 of the locking head 50, which are disposed toward the front end 16 of the housing 14, and therefore may conveniently be called front surfaces 60, 62. As shown in FIG. 8, the front surfaces 60, 62 are disposed on opposite sides of the locking beam 48, and as described in detail below, are configured to allow the locking beam 48 to be moved from the lock position to a "release" position to facilitate removal of the electrical terminal 12 from the housing 14.

Figure 9:
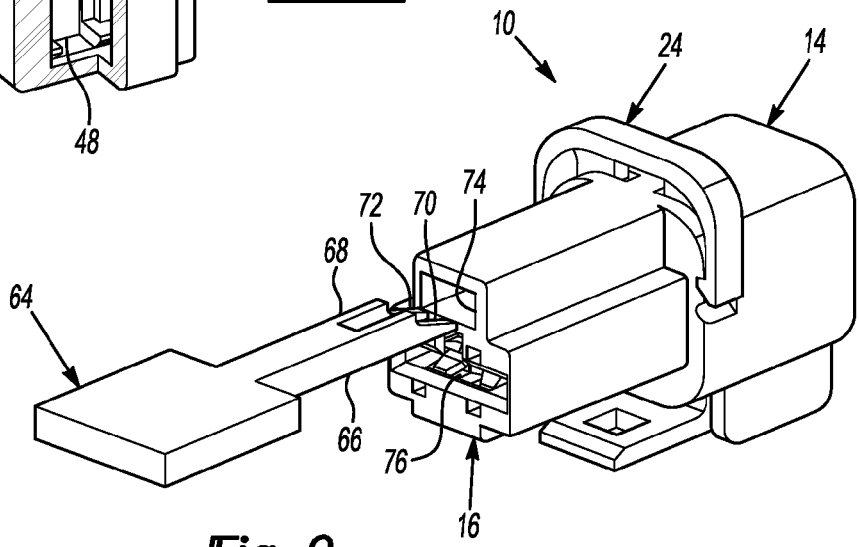
FIG. 9 is a perspective view of the electrical connector shown in FIG. 1 illustrating the use of a removal tool to release the electrical terminal.

FIG. 9 shows the electrical connector 10 in conjunction with a removal tool 64 configured to move the locking beam 48 from the lock position to the release position. In the embodiment shown in FIG. 9, the removal tool is a forked tool having two tines 66, 68, each of which has a respective tapered surface 70, 72, configured to cooperate with a respective one of the front surfaces 60, 62 on the locking beam 48. The tines 66, 68 are spaced apart from each other at least as wide as the width of the locking beam 48, so that they can engage the front surfaces 60, 62 of the locking head 50 to release the locking beam 48. Another opening 76 in the front end 16 of the housing 14 is also illustrated in FIG. 9. The opening 76 is configured to receive a mating terminal for mating with the electrical terminal 12.

Figure 10:
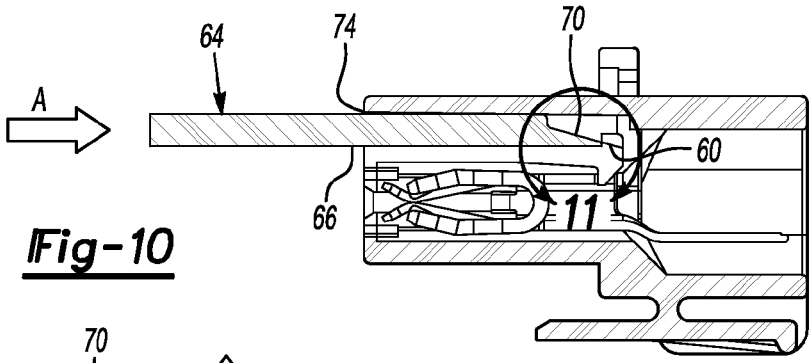
FIG. 10 is a cross-sectional view of the electrical connector and removal tool shown in FIG. 9, with the tool shown in a pre-engaged position.
Figure 11:
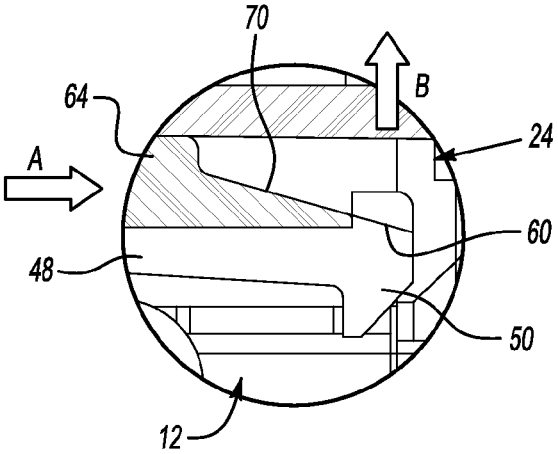
FIG. 11 is a detail view of a portion of FIG. 10.

In FIG. 10, the removal tool 64 is shown after it has been inserted into the opening 74 in the housing 14. As shown in FIG. 10, the front surface 60 of the locking head 50 is being engaged by the corresponding surface 70 of the tine 66. As the removal tool 64 is moved in the direction of arrow (A), the tapered surfaces 60, 70 will slide relative to each other such that the locking head 50 will be moved from the lock position to the release position. This is illustrated more clearly in FIG. 11, which provides a detail of the area indicated by circle 11 in FIG. 10. Specifically, as the removal tool 64 is moved in the direction of arrow (A), the locking beam 48, and in particular the locking head 50, will move upward in the direction of arrow (B) to release the electrical terminal 12 so that it can be removed from the housing 14.

Figure 12:
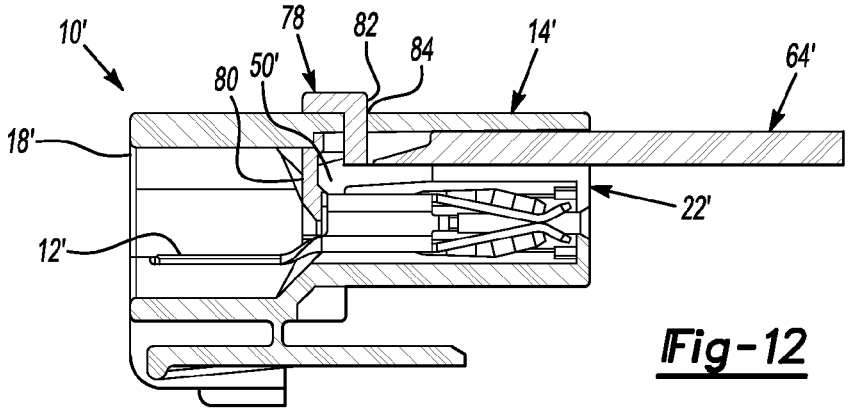
FIG. 12 is a cross-sectional view of an electrical connector in accordance with embodiments of the present invention.

As discussed above, the secondary lock 24 is configured to prohibit removal of the electrical connector 12 from the housing 14 by virtue of its being interposed between the electrical terminal 12 and the back end 18 of the housing 14 when it is in the lock position. In this way, the secondary lock 24 acts independently from the primary lock 22 in keeping the electrical terminal 12 within the housing 14. FIG. 12 shows an electrical connector 10', where the prime symbol (') is used on certain reference numerals to indicate features corresponding to similar features shown in the other drawing figures. The electrical connector 10' includes a primary lock 22' and a secondary lock 78. Similar to the secondary lock 24 illustrated and described above, the secondary lock 78 also has an elongate member 80, which is disposed between an electrical terminal 12' and a back end 18' of the housing 14'. Although only one elongate member 80 is shown, it is understood that the secondary lock 78 may have more than one such elongate member, similar to the secondary lock 24.

In addition to the elongate member 80, which acts independently from the primary lock 22', the secondary lock 78 also includes another blocking member 82, which is disposed through an aperture 84 in the housing 14'. As shown in FIG. 12, the blocking member 82 serves the dual purpose of blocking the locking head 50' from being moved out of the lock position, and blocking the removal tool 64' from reaching the locking head 50'. Therefore, in this embodiment, removal of the electrical terminal 12' from the housing 14' is a two-stage process similar to that described above—the secondary lock 78 is first moved from the lock position (as shown in FIG. 12) to a pre-lock position (see, for example, the secondary lock 24 shown in FIG. 5), and then the removal tool 64' can be fully inserted into the housing 14' to engage the locking head 50' such that it is moved to the release position, whereby the electrical terminal 12' can be removed.

Figure 13:
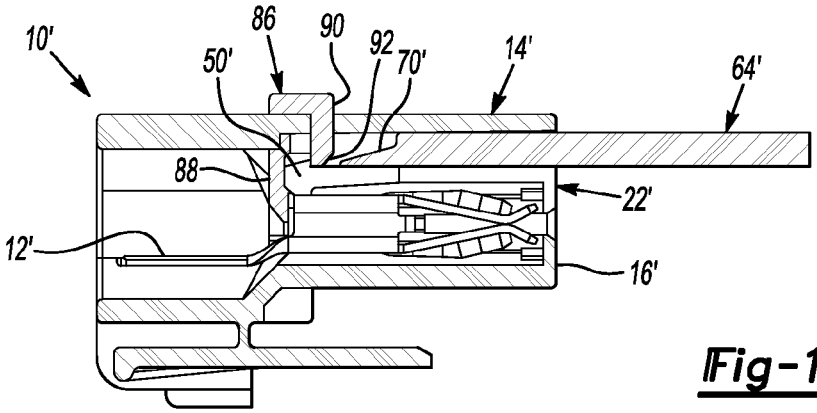
FIG. 13 is a cross-sectional view of an electrical connector in accordance with embodiments of the present invention.

In contrast, FIG. 13 shows the electrical connector 10' with a slightly different secondary lock 86, which, like the secondary lock 78 shown in FIG. 12, includes an elongate member 88 and a blocking member 90. The elongate member 88, which may be a single member or one of a number of elongate members, blocks removal of the electrical terminal 12' from the housing 14' as described above. The blocking member 90, like the blocking member 82, acts on the primary lock 22' to prohibit movement of the locking head 50' from the lock position to the release position. Unlike the blocking member 82, however, the blocking member 90 includes a tapered surface and 92, which faces a front 16' of the housing 14'. In this embodiment, unlocking the primary lock 22' and the secondary lock 86' is a one-stage process, which requires only insertion of the removal tool 64'. When the removal tool 64' is inserted into the housing 14', it first moves the secondary lock 86 from the lock position to the pre-lock position, and then it engages the locking head 50' to move it from the lock position to the release position. After the removal tool 64' is fully inserted, the electrical terminal 12' can be removed from the housing 14'.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An electrical connector, comprising:

an electrical terminal;

a housing having a front end and a back end having an opening configured to receive the electrical terminal therethrough, the housing including a first lock system configured to allow insertion of the electrical terminal into the housing and prohibit removal of the electrical terminal therefrom, the housing including a tapered surface therein for guiding the electrical terminal to a desired position when the electrical terminal is inserted into the housing; and a second lock system configured to cooperate with the housing: in a lock position for prohibiting removal of the electrical terminal from the housing, and in a pre-lock position wherein a tapered surface of the second lock system is configured to cooperate with the tapered surface of the housing for guiding the electrical terminal to the desired position when the electrical terminal is inserted into the housing, and wherein the second lock system is further configured to prohibit removal of the electrical terminal from the housing by blocking movement of the electrical terminal and the first lock system, and is further configured to cooperate with the removal tool such that the removal tool releases the second lock system and the first lock system.

2. The electrical connector of claim 1, wherein the housing includes a housing alignment feature and the electrical terminal includes a terminal alignment feature configured to cooperate with the housing alignment feature such that the electrical terminal is fully insertable in the housing with only one orientation.

3. The electrical connector of claim 1, wherein the second lock system is configured to cooperate with the housing such that the second lock system: is prohibited from being moved from the pre-lock position to the lock position when the electrical terminal is partially inserted into the housing, and is not prohibited from being moved from the pre-lock position to the lock position when the electrical terminal is fully inserted into the housing.

4. The electrical connector of claim 1, wherein the housing includes a wall having an aperture disposed therethrough, and the second lock system includes: a blocking member configured to be disposed through the aperture to an interior of the housing, and a pair of retaining arms configured to be disposed around an outside surface of the housing for retaining the second lock system to the housing.

5. The electrical connector of claim 4, wherein the tapered surface of the second lock system is disposed on the blocking member facing the back end of the housing when the blocking member is disposed through the aperture, such that the blocking member facilitates insertion of the electrical terminal into the housing from the back end when the second lock system is in the pre-lock position.

6. The electrical connector of claim 1, wherein the first lock system includes a cantilevered beam with a locking head movable from a lock position to a release position and having a first tapered surface disposed toward the back end of the housing configured to cooperate with the tapered surface of the housing and the tapered surface of the second lock system for guiding the electrical terminal to the desired position when the electrical terminal is inserted into the housing.

7. The electrical connector of claim 6, wherein the locking head includes a second tapered surface disposed toward the front end of the housing for cooperating with a corresponding tapered surface of a removal tool for moving the locking head from the lock position to the release position.

8. The electrical connector of claim 6, wherein the locking head includes a pair of second tapered surfaces disposed on opposite sides of the cantilevered beam toward the front end of the housing for cooperating with a forked removal tool having a pair of tines each having a tapered surface thereon for cooperating with a respective one of the second tapered surfaces for moving the locking head from the lock position to the release position.

9. An electrical connector, comprising:

an electrical terminal;

a housing including:

a front end, a back end including an opening therein for facilitating insertion of the electrical terminal into the housing such that the housing at least partially encloses the electrical terminal, a wall having a tapered interior surface for guiding the electrical terminal to a desired position when the electrical terminal is inserted into the housing, and a locking beam having a lock position for prohibiting removal of the electrical terminal from the housing and a release position for facilitating removal of the electrical terminal from the housing, the locking beam including a pair of front surfaces disposed on opposite sides thereof and tapered toward the front end of the housing for cooperating with a forked removal tool having two tines spaced apart from each other, each of the tines having a mating tapered surface thereon for cooperating with a respective one of the front surfaces of the locking beam; and a blocking member having a tapered surface thereon and configured for insertion into the housing such that: when the blocking member is partially inserted into the housing, the tapered surface of the blocking member cooperates with the tapered interior surface of the wall for guiding the electrical terminal to the desired position when the electrical terminal is inserted into the housing, and when the blocking member is fully inserted into the housing, the blocking member blocks removal of the electrical terminal from the housing.

10. The electrical connector of claim 9, wherein the locking beam includes a back surface tapered toward the back end of the housing configured to cooperate with the tapered interior surface of the wall and the tapered surface of the blocking member for guiding the electrical terminal to the desired position when the electrical terminal is inserted into the housing.

11. The electrical connector of claim 9, wherein the housing is configured to receive the blocking member at a position in the housing such that when the electrical terminal is partially inserted into the housing, the electrical terminal prohibits the blocking member from being fully inserted into the housing.

* * * * *